US006177046B1

(12) United States Patent
Simkovich et al.

(10) Patent No.: US 6,177,046 B1
(45) Date of Patent: Jan. 23, 2001

(54) SUPERALLOYS WITH IMPROVED OXIDATION RESISTANCE AND WELDABILITY

(75) Inventors: George Simkovich; Eric J. Whitney, both of State College, PA (US)

(73) Assignee: The Penn State Research Foundation, University Park, PA (US)

( * ) Notice: Under 35 U.S.C. 154(b), the term of this patent shall be extended for 0 days.

(21) Appl. No.: 09/075,102

(22) Filed: May 8, 1998

Related U.S. Application Data

(63) Continuation-in-part of application No. 08/630,812, filed on Apr. 10, 1996, now abandoned.

(51) Int. Cl.[7] ..... C22C 19/05
(52) U.S. Cl. ..... 420/444; 148/427; 148/442
(58) Field of Search ..... 148/408, 409, 148/410, 419, 428, 442; 420/35, 95, 97, 436, 440, 443, 444

(56) References Cited

U.S. PATENT DOCUMENTS 4,061,495 * 12/1977 Selman et al. ..... 420/444
4,261,742 * 4/1981 Coupland et al. ..... 420/443
4,447,503 * 5/1984 Dardi et al. ..... 428/632
4,719,080 * 1/1988 Duhl et al. ..... 420/443

* cited by examiner

*Primary Examiner*—John Sheehan
*Assistant Examiner*—Andrew L. Oltmans
(74) *Attorney, Agent, or Firm*—Thomas J. Monahan

(57) ABSTRACT

Improved Ni, Fe and Co based superalloys having excellent oxidation resistance and weldability. The superalloys are obtained by at least partially replacing the Ni in conventional superalloys with Pd. The alloys may also contain strengtheners and modifiers such as Co, W, Mo, V, Ti, Re, Ta, Nb, C, B, Zr, Y, and Hf. The superalloy has good strength, improved weldability and excellent oxidation resistance suitable for use in many aerospace and power generation turbine applications. A preferred embodiment comprises (in wt %) 1–9% (Al+Ti), 0–0.01% B, 0–0.15% C, 0–25% Co, 5–30% Cr, 0–10% Fe, 0–0.009% (Hf+Y+Sc), 1–15% (Mo+W), 0–8% (Nb+Ta), 40–68% Ni, 4–32% Pd, 0–10% (Re+Rh), 0–5% V, and 0–0.015% Zr.

2 Claims, 9 Drawing Sheets

SUPERALLOYS WITH IMPROVED OXIDATION RESISTANCE AND WELDABILITY

This application is also a continuation-in-part of Ser. No. 08/630,812 filed Apr. 10, 1996 now abandoned.

PRIORITY AND GOVERNMENT SPONSORSHIP

This invention was made with Government support under Contract Number N00039-92-C-0100 awarded by the United States Department of the Navy. The Government has certain rights in this invention.

FIELD OF THE INVENTION

The present invention relates to the field of superalloys containing palladium. The invention is particularly drawn to nickel-based superalloys useful in aerospace and power generation turbine applications. The superalloy's weldability, strength and excellent oxidation resistance properties make it useful in turbine blade tip manufacturing or refurbishment as well as in other high temperature components such as combusters, nozzles, flame holders and seals where these properties are desirable or critical.

BACKGROUND OF THE INVENTION

The term "superalloy" is used to represent complex nickel, iron, and cobalt based alloys containing additional metals such as chromium, aluminum, titanium, tungsten, and molybdenum. The term "based" as used herein means that that element is the largest weight fraction of the alloy. The additives are used for their high values of mechanical strength and creep resistance at elevated temperatures and improved oxidation and hot corrosion resistance. For nickel based superalloys, high hot strength is obtained partly by solid solution hardening using such elements as tungsten or molybdenum and partly by precipitation hardening. The precipitates are produced by adding aluminum and titanium to form the intermetallic compound γ' ("gamma prime"), based on $Ni_3(Ti,Al)$, within the host material.

The properties of superalloys make them desirable for use in corrosive and/or oxidizing environments where high strength is required at elevated temperatures. Superalloys are especially suitable for use as material for fabricating components such as blades, vanes, etc., for use in gas turbine engines. These engines usually operate in an environment of high temperature and/or high corrosiveness. Therefore a need exists for alloys with high temperature oxidation resistance and/or good hot corrosion resistance.

Nickel based superalloys are well known in this field. For instance, U.S. Pat. No. 4,261,742 to Coupland et al. discloses a superalloy consisting essentially of 5 to 25 wt % chromium, 2 to 7 wt % aluminum, 0.5 to 5 wt % titanium, at least one of the metals yttrium and scandium present in a total amount of 0.01 to 3 wt %, 3 to 15 wt % in total of one or more of the platinum group metals, and the balance nickel. The Coupland et al. superalloy has increased oxidation and hot-corrosion resistance and may be used as a material for fabricating blades or vanes of gas turbine engines or components used in coal gasification systems. Also, U.S. Pat. No. 4,018,569 to Chang discloses an alloy consisting essentially of 8 to 30 wt % aluminum, 0.1 to 10 wt % hafnium, 0.5 to 20 wt % of an element selected from the group consisting of platinum, rhodium and palladium, 0 to 3 wt % yttrium, 10 to 40 wt % chromium, and the balance comprising an element selected from the group consisting of iron, cobalt and nickel. The Chang superalloy has improved environmental resistance which may be used to improve the temperature capability of components in gas turbine engines. However, neither Coupland et al. nor Chang disclose superalloy compositions containing palladium in amounts sufficient to improve the weldability of the superalloy in accordance with the requirements of the present application. These patents are hereby incorporated by reference.

Other patents are known that disclose high temperature nickel containing alloys. Some examples include: U.S. Pat. No. 4,149,881 to D'Silva, U.S. Pat. No. 4,414,178 to Smith, Jr. et al., U.S. Pat. No. 4,719,081 to Mizuhara, and U.S. Pat. No. 4,746,379 to Rabinkin, all hereby incorporated by reference. These patents disclose alloys with various amounts of palladium, chromium and nickel but do not contain aluminum which is a required element of the present invention.

Current and next generation turbofan turbine engines use nickel based superalloys for many of the components in the high temperature sections of an engine. These sections include the later stages of the high pressure compressor, the combuster, the high and low pressure turbine, and the exhaust modules. These components are subjected to a wide variety of service related degradation including oxidation, fatigue, creep, corrosion, and erosion. In nearly all applications, more than one of these phenomena occurs during turbine engine operation. As a result, alloy design principally has been concerned with improving the thermomechanical properties of the alloys. Produceability of the alloy, i.e., weldability, castability, forgeability, and machineability are often considered a secondary or tertiary criterion during alloy design. However, when weldability is considered during alloy design the resulting material may be widely used. For example, Alloy 625 and its derivatives (including Alloy 718) are the most widely used superalloys in the world [H. L. Eiselstein and D. J. Tillack "The Invention and Definition of Alloy 625", Superalloys 718, 625 and Various Derivatives, Conference Proceedings, Pittsburgh Pa., June 1991, ed. E. A. Loria].

To improve the oxidation resistance and strength of Ni alloys, successive generations of alloys have incorporated increasingly higher levels of aluminum and to a lesser extent titanium. Both Al and Ti are detrimental to weldability.

There are several modes of cracking that can occur during welding. One of the most troublesome is strain age cracking of the weld metal or in the heat affected zone of the base material. Strain age cracking is the principal reason why nickel based superalloys are considered to be difficult to weld [Welding Handbook Vol. 4, Seventh Edition, ed. by W. H. Kearns, p. 233 and 236, ©1982 American Welding Society]. This type of cracking can occur during cooling from weld temperature, during post weld heat treatment, or during the application of subsequent weld passes. The primary reason these alloys exhibit strain age cracking is that the aging kinetics of the γ' phase is very fast and the alloy can not accommodate the resulting strain without cracking. FIG. 1 shows the relationship between an alloy's Al+Ti content and weldability [M. Prager and C. S. Shira, *Weld. Res. Counc. Bul.*, 128, 1968]. Note that alloys containing greater than about 3 wt % Al are considered difficult to weld, in addition as Ti levels increase the allowable amount of Al present in the alloy also decreases. Also note that this chart was developed before applicant's discovery of the affect of the addition of palladium to superalloys, which allows higher amounts of Al+Ti to be included in the composition at the same level of weldability. This is discussed more fully below.

For alloys that lie close to the line, such as Rene'41 and Waspaloy, special heat treatments have been used to reduce cracking. For example, over aging Rene'41 has been shown to reduce strain age cracking through the coarsening of the γ' phase [W. P. Hughes and T. B. Berry, "A Study of the Strain-Age Cracking Characteristics in Welded Rene'41-Phase 1", Welding Journal, August 1967, p 361–370].

It is common for current generation superalloys to have as much as 12% Al with little or no Ti present. The impossibility of welding these alloys has a significant impact on the repairability of components made from such alloys. For example, a turbine blade may be removed from service due to tip wear while the component still has a significant portion of its design life remaining. It is desirable to weld repair the worn area and return the component to service. Currently these components are repaired using a solid solution strengthened alloy such as Alloy 625, Hastelloy X, L605, or HS188. However, these alloys lack the strength and oxidation resistance of the original material; as a result the repaired components suffer rapid degradation during subsequent service.

Several other types of cracking can occur in superalloy weldments. For castings and large grain wrought materials grain boundary liquation cracking or hot shortness may occur. This type of cracking is minimized by using a low heat input process such as laser, electron, or micro plasma arc welding and controlling the level of carbide forming and impurity elements [T. J. Kelley, "Welding Metallurgy of Investment Cast Nickel-Based Superalloys", Weldability of Materials, Conference Proceedings, ed. R. A. Patterson and K. W. Mahin, ©1990 ASM International]. Also, weldments can also suffer from nil ductility cracking and restraint cracking. Both of which are best minimized by proper weld schedule development and process control.

Current generation Ni based superalloys derive their oxidation resistance from the formation of an extremely adherent and cohesive $Al_2O_3$ surface layer. The formation of the $Al_2O_3$ film depends on the Al content of the alloy and other elements such as Cr, Y, Hf, and Ti [C. T. Sims and W. C. Hagel, eds., *The Superalloys*, ©1972 Wiley, N.Y.]. However, increasing aluminum content is the most effective method of improving oxidation resistance. Increasing the aluminum content is limited by the need to balance other thermomechanical properties. As a result oxidation resistant coatings have been developed to increase the Al content at the surface. One technique is to apply a diffusion aluminide coating where Al is applied by a pack cementation or a chemical vapor deposition process. Other coating systems are based on the MCrAlX (M can be Ni and/or Co and X can be Y and/or Hf) alloys. These alloys are similar to superalloys except they are very high in Al and contain as much as 1.5% Y or Hf. These coatings are applied by physical vapor deposition or a thermal spray process. One variation of the above coating is to electroplate onto the surface of a component Pd to improve the oxidation and corrosion resistance [S. Alperine, P. Steinmetz, A. Friant-Costantini, P. Josso, "Structure and High Temperature Performance of Various Palladium-Modified Alumined Coatings: A Low Cost Alternative to Platinum Aluminides," *Surface and Coating Technology*, 43/44 (1990), 347–358; P. Lamesle and P. Steinmetz, "Growth Mechanisms and Hot Corrosion Resistance of Palladium Modified Aluminide Coatings on Superalloys", Materials andManufacturing Processes, vol. 10, no. 5, 1053–1075, (1995)].

At Penn State, work has been performed studying the effects of Pd on the oxidation behavior of Mo—Cr and Mo—W—Cr alloys [D. Lee and G. Simkovich, "Oxidation of Molybdenum-Chromium-Palladium Alloys," *Oxidation of Metals*, 34, Nos. ½, (1990); D. Lee and G. Simkovich, "Oxidation of Mo—W—Cr—Pd Alloys," *Journal of Less Common Metals*, 163 (1990), 51–62]. The results show that 1–3 wt. percent Pd is sufficient to significantly improve the high temperature oxidation resistance of the alloy systems. The researchers hypothesized that Pd acts as a Cr reservoir for the formation of $Cr_2O_3$ and as a barrier to the inward diffusion of oxygen. There have not been previous studies on the effects that Pd additions have on the oxidation resistance of Ni based superalloys.

Previous work on platinum additions to superalloys has shown a beneficial effect on oxidation behavior at high temperature. Platinum concentrations of about 1–3 weight percent were shown to significantly reduce the high temperature oxidation rate of the base metal. The improvement was attributed to an increase in the diffusion rate of other species [I. M. Allam, H. C. Akuezue, and D. P. Whittle, "Influence of Small Pt Additions on $Al_2O_3$ Scale Adherence", *Oxidation of Metals*, Vol. 14, No. 6, 1980]. This may be due to an increase in lattice parameter of the γ phase caused by the presence of Pt. In the presence of Hf, Pt promotes inwardly growing $Al_2O_3$ pegs that reportedly increased scale adherence [G. J. Tatlock and T. J. Hurd, "Platinum and the Oxidation Behavior of a Nickel Based Superalloy",*Oxidation of Metals*, Vol. 22, Nos. 5/6, 1984]. It is possible that Pd additions may also increase oxide scale adherence by the same or other mechanisms.

The surface segregation of Cr, Pd, Mo, and Ni for a high chromium ferritic stainless steel has bee studied [W. E. Delport and J. P. Roux, "The Surface Segregation and Oxidation of Chromium and Palladium in High Chromium Stainless Steels", *Corrosion Science*, Vol. 26, No. 6, pp. 407–417, 1986]. The investigators found that at 550° C. palladium oxidation is virtually complete before the oxidation of chromium begins. Also, the data suggests that Cr diffuses more rapidly through PdO than through the bulk material. This data suggests that the passivation characteristics of a ferritic stainless steel would be improved if a small amount of palladium (approximately 0.4 weight percentage) is added to the steel. Unfortunately, the study did not investigate high temperatures, where the formation of PdO can not occur.

Gas turbine engines are used in a wide variety of applications including commercial and military aircraft and for electrical power generation. Fuel efficiency is a major concern for turbine manufacturers and operators. Considerable effort is expended during the design of turbines to improve fuel efficiency over earlier models, and operators spend a large part of their maintenance effort to maintain fuel efficiency. Fuel represents a major cost for both airlines and electric utilities.

Fuel efficiency is increased over earlier engines by incorporating new designs that take advantage of advances in aerodynamics and computer simulation. Fuel efficiency is also increased by incorporating advanced materials that allow the engine to operate at higher combustion temperatures. Higher combustion temperature results in more complete burning of the fuel. New materials are usually more expensive due to an increase in raw material and manufacturing costs. Often these costs are more than offset by a decrease in fuel costs. Superalloys have been used extensively in the hot sections of turbine engines because of their high strength and excellent resistance to oxidation (usually with the addition of a coating). Unfortunately superalloys are very difficult to fusion weld. The inability to fusion weld superalloys results in increased new part manufacturing cost and an increase in maintenance costs. It is desirable to develop a new alloy that has both excellent oxidation resistance and is more weldable than current alloys.

Turbine efficiency is reduced when excessive clearances develop between rotating components and stator components. In the turbine, unwanted clearances develop due to the thermomechanical degradation of the blade tip allowing airflow to leak past the blades. Often turbine blade tip degradation becomes severe enough for the operator to remove the blade from service for repair. The repair consists of welding a sufficient amount of repair material to the tip and recontouring the blade to final dimensions. The repair material is often Alloy 625. This material is a solid solution strengthened nickel alloy that has inferior oxidation resistance to the original blade material. However, Alloy 625 exhibits excellent weldability compared to most original blade materials which have such poor weldability that they can not be used as the repair material.

Because most repair material, frequently Alloy 625, has poor oxidation resistance, it does not maintain clearances and causes the turbine blades to be removed frequently for additional repairs. By substituting Alloy 625, or another repair material, with the subject invention, the turbine operator will realize a reduction in fuel consumption and maintenance costs

SUMMARY OF THE INVENTION

Accordingly, there is a need for a new alloy that provides for improved weldability while maintaining the oxidation resistance similar to that of traditional superalloys. The present invention is a new superalloy with improved weldability, excellent oxidation resistance and strength adequate for aerospace and power generation turbine applications. The alloy derives improved weldability, in part, from the addition of palladium. It is preferred that the palladium substitute for Ni in conventional type nickel-based superalloys. The palladium also improves high temperature oxidation resistance and provides solid solution strengthening.

Palladium additions may improve weldability via four mechanisms: (1) Pd increases aluminum solubility in the system resulting in a decrease in the volume fraction of $\gamma'$, (2) Pd may decrease the $\gamma'$ solvus temperature, increase the $\gamma'$ coarsening rate and reduce strain age sensitivity, (3) Pd may delay the onset of $\gamma'$ precipitation during post weld cooling, and (4) Pd may increase lattice mismatch in the presence of a species that exclusively substitutes for aluminum in $\gamma'$. The palladium additions may improve oxidation via the following mechanisms: (1) Pd will increase the aluminum solubility in the system resulting in more Al available to form an oxide scale, (2) a Pd enriched layer will form near the surface increasing the diffusion distance for other elemental constituents, and (3) Pd may inhibit the diffusion of oxygen into the substrate thereby reducing internal oxidation.

One intended use for the alloy is as a filler metal for turbine blade tip manufacturing or refurbishment. Currently, there is no superalloy tip material being used as a refurbishment material. Other high temperature components such as combusters, nozzles, and seals can also be welded (for new part or refurbishment) using the new alloy.

Another use of the alloy would be structural components of a turbine engine, particularly components that require excellent oxidation resistance and may require repair during the lifetime of the component. Such a repair may involve welding to restore dimensional and structural integrity to the part. It would be important in such a repair that welding does not induce cracks that may promote early and potentially catastrophic failure.

For the purposes of this invention disclosure the term 'welding' refers to a fusion weld process with or without a filler material. This type of welding can be performed when dimensional restoration is required or when piece parts are joined to form an inseparable assembly.

When used as a repair material for turbine blade tips the new alloy will save energy by reducing the amount of degradation in efficiency due to normal operation of a gas turbine (i.e., the turbine will maintain its designed efficiency for longer periods of time). Energy will also be saved by allowing the design of turbines with improved efficiency over those currently available. There is potential to significantly increase the savings by incorporating the new alloy into more than one application. Further, energy savings may be realized when the new alloy is used in other applications in a turbine.

The new alloys of the present invention provide for weldable oxidation resistant superalloys that are currently unavailable. The alloy will allow jet engine manufacturers and overhaulers to provide improved components at a manufacturing cost similar to current repair techniques. In addition it will allow components to be repaired using existing processes. It will also allow the repair of components with similar oxidation resistance as the original material so no loss of performance is experienced.

The alloys represent a departure in design philosophy usually employed in the development of superalloys. Typically weldability is not a design criterion. In this approach weldability and oxidation are primary design criteria along with elevated temperature mechanical properties. It is believed that the palladium additions will help to achieve the design goals.

These and other advantages of the present invention are accomplished, in part, by either replacing nickel with palladium in an existing superalloy or by designing new alloys with palladium as a major alloying constituent. The new alloy can be based on conventional nickel, iron, or cobalt based materials, including superalloys. Further, the new alloy may be an enhancement to mechanically alloyed or aluminide classes of materials. In its broadest embodiment, superalloys of the present invention fall within the scope of the following ranges:

| Element | Range (wt. %) |
|---|---|
| Al + Ti | 0.5–10 |
| B | 0–0.01 |
| C | 0–0.15 |
| Co | 0–25 |
| Cr | 5–30 |
| Fe | 0–70 |
| Hf + Y + Sc | 0–0.009 |
| Mo and/or W | 0.5–20 |
| Nb and/or Ta | 0–8 |
| Ni | 0–70 |
| Pd | 2–50 |
| Pd + Ni + Fe | 50–72 |
| Re and/or Rh | 0–10 |
| V | 0–5 |
| Zr | 0–.015 |

DETAILED DESCRIPTION OF THE INVENTION

Pd is a face centered cubic metal and exhibits complete substitutional solid solubility with Ni [*Metals Handbook*, Vol. 8, 8th Ed., © American Society for Metals, 1973; *Binary Alloy Phase Diagrams*, Vol. 3, 2nd Ed., T. B. Massalski Ed., © ASM Int., 1990]. However, Pd has a higher solid solubility for Al. For example, Ni has an Al solubility at 1000° C. of 14 atomic percent while Pd at the same temperature has an Al solubility of 20 atomic percent. Similarly, at 800° C. the Al solubility in Ni and Pd is 10 and 17 atomic percent respectively.

There is no Al—Pd—Ni ternary phase diagram available, a review of the binary phase diagrams shows that there is a Pd—Al eutectic at approximately 23 atomic percent Al that melts at 1055° C. In the Ni—Al system there is a eutectic at approximately 13 atomic percent Al that melts at 1385° C. As a result it may be expected that a ternary eutectic may exist in the 13–23 atomic percent region and may have a melting point between 1055° C. and 1385° C. From this information it can be hypothesized that the γ' aging kinetics may be favorably influenced, i.e., decreasing γ' precipitation rate with the addition of Pd. This would have a favorable impact on a weld to resist strain age cracking either occurring during post weld heat treatment or in the weld bead during subsequent weld passes. Thus the addition of palladium to superalloys has been found by applicant to allow higher amounts of Al+Ti to be included in the composition at the same level of weldability.

Table 1 shows the relevant crystallographic data for Ni, Pd, and Al. Note that the atomic radius and lattice constant are more closely matched for Pd and Al than for Ni and Al. According to alloying rules first proposed by Hume-Rothery, the closer the match between atomic radii the higher the solubility of the solute [*Physical Metallurgy Principles*, Second Edition, by Robert E. Reed-Hill, ©1973 Litton Educational Publishing Inc.]. This criterion, known as the size factor, states that atomic radii differences of less than 15% can result in substantial solid solubility. This limitation is associated with the strain induced by the solute atoms in the lattice. Note that the difference between Ni and Al is 13% while the difference between Pd and Al is only 4%. This supports the conclusions reached by inspection of the phase diagrams.

TABLE 1

Crystal Structure Of Ni, Pd, and Al

| Element | Crystal Type | Atomic Radius | Lattice Constant |
|---|---|---|---|
| Ni | FCC | 1.246 | a = 3.5238 |
| Pd | FCC | 1.376 | a = 3.8902 |
| Al | FCC | 1.432 | a = 4.0391 |

values given in angstroms

Figure 1:
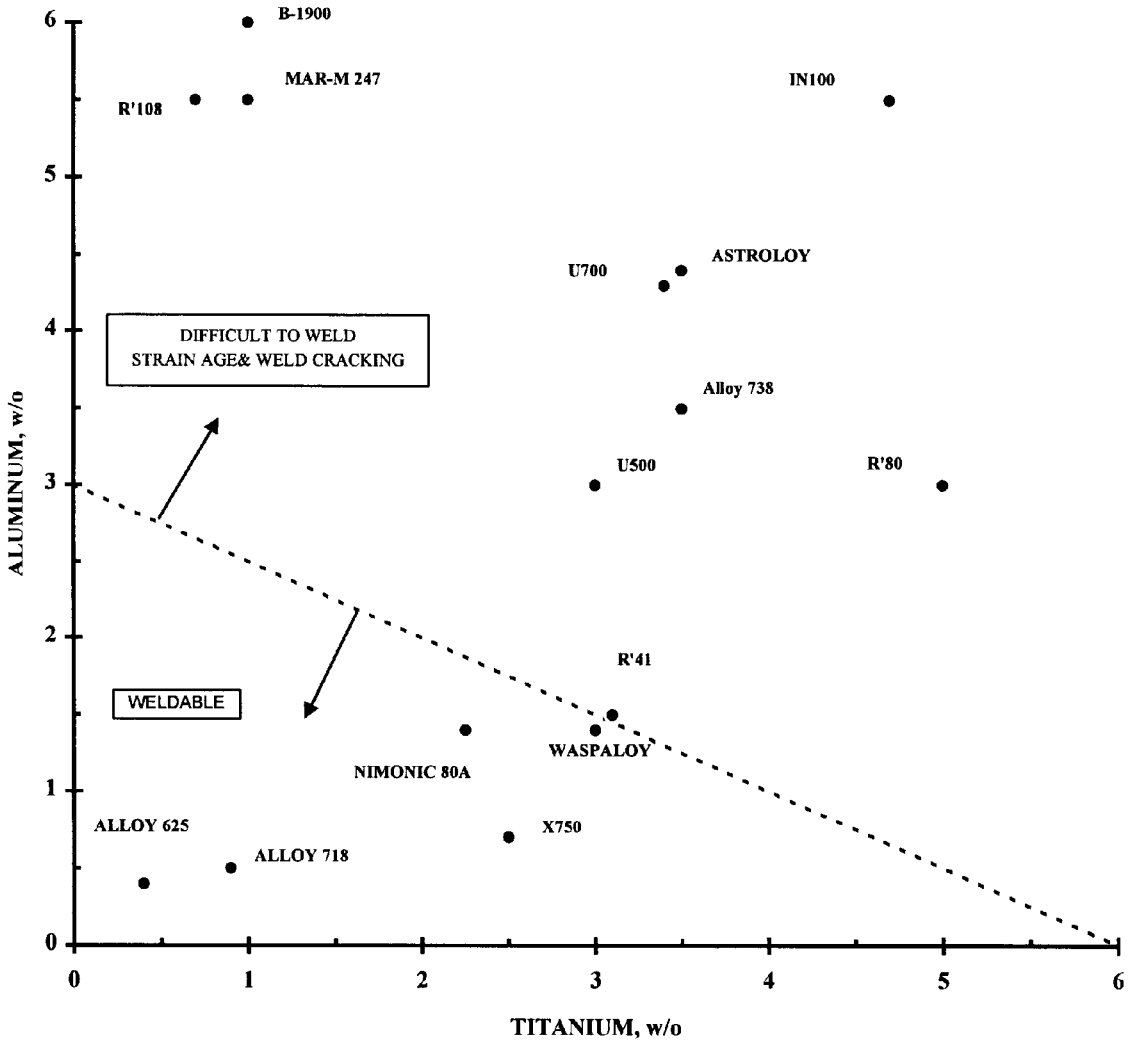
FIG. 1 is a graph showing the weldability as a function of aluminum and titanium content in alloys that do not contain palladium [not the present invention].
Figure 2:
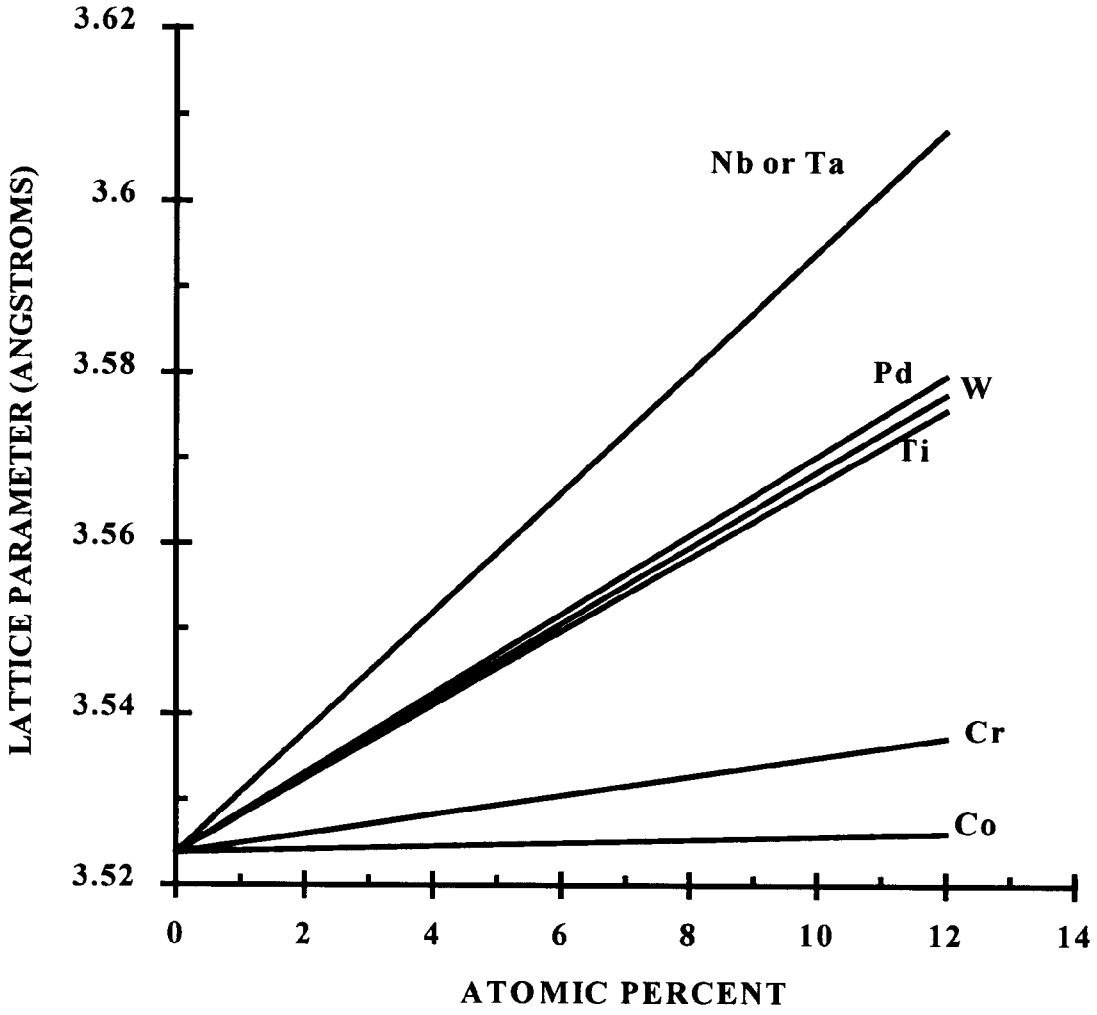
FIG. 2 is a graph showing the effect of solute concentration on the lattice parameter of gamma nickel.

The change in γ and γ' lattice parameters as a function of alloying element has been studied previously [M. Yoshinao, O. Shouichi, and T. Suzuki, "Lattice Parameters of Ni(γ), $Ni_3Al$(γ'), and $Ni_3Ga$(γ') Solid Solutions with Additions of Transition and B-Subgroup Elements", *Acta Metallurgica*, Vol. 33, No. 6, pp. 1161–1169, 1985, © 1985 Pergamon Press Ltd.]. FIG. 2 shows the effect of solute concentration on the lattice parameter of gamma nickel. Palladium has a significant effect on the γ' lattice parameter, of the elements shown only Nb and Ta have a larger effect. Note that the solubility limit of each element has not been accounted for in the figure.

Figure 3:
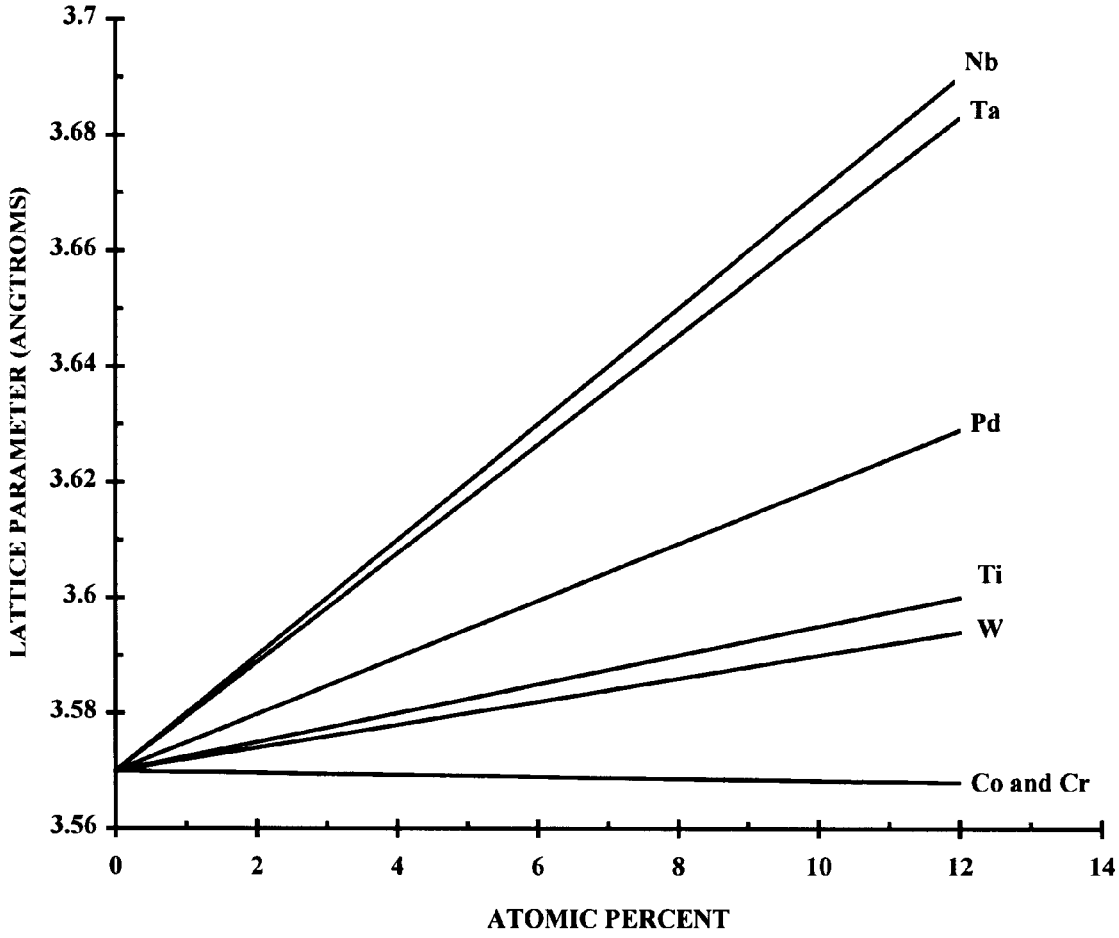
FIG. 3 shows the effect of solute concentration on the lattice parameter of $Ni_3Al$.

FIG. 3 shows the effect of solute concentration on the lattice parameter of $Ni_3Al$. Pd has a large effect on the $Ni_3Al$ lattice parameter. Pd replaces Ni in γ' and in a ternary Ni—Pd—Al systems partitions equally between γ and γ'. This results in little net change in the lattice mismatch between γ and γ'.

The alloying behavior of a variety of $Ni_3X$ (X can be Al, Ga, Si or Ge) compound has been investigated [S. Ochiai, Y. Oya, T. Suzuki, "Alloying Behavior of $Ni_3Al$, $Ni_3Ga$ $Ni_3Si$ and $Ni_3Ge$", *Acta Metallurgica*, Vol. 32, 289, 1984, © 1984 Pergamon Press Ltd.]. Palladium was shown to substitute exclusively for nickel. At 1050° C. Pd has a solubility in γ' of approximately 15 atomic percent. In superalloys, cobalt is the only other common element that was shown to substitute for nickel, however its γ' solubility decreases with increasing temperature. Most other elements partition to Al sites or will substitute for both Ni and Al. For example, Ti and Nb will partition to the γ' Al sites and result in an increase in lattice parameter mismatch. Cr will partition to either Ni or Al sites, however Al sites are more likely to be occupied by Cr.

The addition of palladium will not promote the formation of topologically close packed phases such as ρ, μ, or Laves. This is because palladium has nearly the same electron hole number as nickel (0.61 for nickel compared to approximately 0.66 for palladium) [*Heat Treatment Structure and Properties of Nonferrous Alloys* by C. R. Brooks, © 1984 American Society for Metals, p. 199]. As a result, PHACOMP calculations yield about the same electron hole numbers for alloys with nickel or palladium. The formation of TCP phases is not a problem when substituting Ni with Pd in existing superalloys.

It is difficult to predict the effect palladium will have on the lattice parameter mismatch, γ' solvus temperature, γ' coarsening rate, Pd partitioning, aluminum solubility, the formation of other Pd bearing intermetallics, and the role Pd has in oxidation. However, the information taken from various binary and ternary systems indicates that palladium can favorably impact weldability and oxidation resistance.

If palladium partitions equally between γ and γ', then there would be little effect on the hardening affect of the γ'; however, the increase in aluminum solubility should reduce the total volume fraction present at any given temperature. If Pd does not partition equally, then the lattice mismatch will increase and the hardening affect of the γ' will decrease.

Because of the high solubility of Al in Pd and the presence of a low melting point Al—Pd eutectic a decrease in the γ' solvus may occur in complex alloys. This would delay the onset of γ' precipitation during cooling from welding temperatures. The strains induced by cooling may be more easily accommodated. Also, the lower solvus temperature would put more aluminum into solution at operating temperature.

Although the beneficial effect of Pt on oxidation resistance has been shown, there are no documented studies on the effect of Pt on weldability. This is probably because the Pt levels were thought to be too small to have a measurable affect on weldability. More importantly, weldability was not a concern for the alloy designers investigating Pt additions to superalloys.

A review of the Pt—Al phase diagram shows that Pt has less solubility for aluminum at 1000° C. than either Ni or Pd at the same temperature [P. R. Hultgren, Selected Values of Thermodynamic Properties Supp. 1, part 1, Alloys, © 1963 John Wiley & Sons]. As a result, the solubility of Al in γ would not increase. This would effectively result in little or no reduction in γ' volume fraction. Since platinum is also likely to partition equally between γ and γ' there would be no net increase in lattice mismatch.

A necessary condition for a species to improve weldability is that it must replace exclusively Ni in γ' and its solubility for aluminum must be greater than that of nickel. Pt does not meet the second condition. Palladium, however, appears to meet the necessary conditions to improve both oxidation and weldability.

EXAMPLE 1

To improve the weldability and oxidation resistance of an existing superalloy it is proposed to substitute up to approximately half of the nickel by weight with palladium. The exact level of substitution will be dictated by the amount of Pd necessary to improve weldability. It is likely that the higher the Al+Ti percentage in the alloy the higher the concentration of Pd necessary to make a noticeable improvement in weldability. Once the substitution is made the weight percent of the other constituents would be adjusted to maintain the same atom proportions as the original alloy. The following example given in Tables 2 and 3 illustrates the technique for modifying IN738 alloy to one of the instant invention [*Superalloys A Technical Guide*, ed. E. F. Bradley, © 1988 ASM International]:

TABLE 2

Nominal Composition of IN738

| | C | Ni | Cr | Co | Mo | Al | B | Ti | W | Zr | Ta | Nb |
|---|---|---|---|---|---|---|---|---|---|---|---|---|
| w % | 0.17 | 61.3 | 16 | 18.5 | 1.75 | 3.4 | 0.01 | 3.4 | 2.6 | 0.1 | 1.75 | 0.9 |
| a % | 0.8 | 59.1 | 17.4 | 18.2 | 1.0 | 7.1 | 0.05 | 4.0 | 0.80 | 0.06 | 0.91 | 0.55 |

TABLE 3

Nominal Composition of IN738 with Pd Additions

| | C | Ni | Pd | Cr | Co | Mo | Al | B | Ti | W | Zr | Ta | Nb |
|---|---|---|---|---|---|---|---|---|---|---|---|---|---|
| w % | 0.15 | 36.7 | 30 | 13.8 | 7.4 | 1.5 | 2.9 | 0.01 | 2.9 | 2.3 | 0.09 | 1.5 | 0.78 |
| a % | 0.8 | 40.7 | 18.4 | 17.4 | 8.21 | 1.0 | 7.1 | 0.05 | 4.0 | 0.80 | 0.06 | 0.91 | 0.55 |

The amount of Pd necessary to make a noticeable improvement in IN738 weldability must be determined experimentally. Once the Pd level has been determined then other thermomechanical, oxidation and corrosion properties must be determined to establish suitability for a particular application.

In order to minimize the amount of Pd necessary to achieve the desired properties a new alloy has been designed. Design criteria for the new alloy are to maximize weldability and oxidation resistance while maintaining other properties, such as creep and rupture, at levels that would meet an intended application. For example, turbine blade tip repair requires that the tip posses a minimum rupture strength and some resistance to thermomechanical fatigue. The present inventors have established a base alloy on which other alloys can be designed to meet particular needs. The alloy consists of Ni, Pd, Cr, and Al. Other elements may be added to increase various thermomechanical properties. Table 4 shows the limits on the base alloy. It is preferred that the total wt % of Ni+Pd or of Ni+Pd+Fe (if Fe based) lies within the range of 50–80.

TABLE 4

Limits on Ni Superalloy with Pd

| ELEMENT | WEIGHT PERCENT |
|---|---|
| Nickel | balance |
| Palladium | 0.5 to 50 |
| Chromium | 0.5 to 30 |
| Aluminum | 0.5 to 20 |

Solid solution strengtheners such as Co, W, Mo, V, Ti Re, Ta, Nb are added to improve tensile strength. Gamma prime modifiers such as W, Mo, V, Ti Ta, and Nb are added to improve alloy strength and creep resistance, especially after an aging treatment. Grain boundary strengtheners such as C, B, and Zr are added to reduce grain boundary sliding that may occur during creep. Finally, Y and Hf are added to improve oxidation behavior, if necessary.

EXAMPLE 2

To improve the weldability and oxidation resistance of existing superalloys it is proposed to add palladium to the system. Table 5 shows the composition of a test alloy that was based on Alloy 738. In the test alloy, indicated by Alloy A, Pd simply added to the base alloy in an amount necessary to achieve approximately 20 atomic percent palladium. All other atom fractions of all other constituents were then reduced.

TABLE 5

| | Elements (atomic percent) | | | | | | | | | | | | |
|---|---|---|---|---|---|---|---|---|---|---|---|---|---|
| | Al | B | C | Co | Cr | Mo | Nb | Ni | Pd | Ta | Ti | W | Zr |
| Alloy 738 | 6.92 | 0.06 | 0.47 | 8.01 | 17.22 | 1.02 | 0.57 | 59.81 | 0.0 | 0.92 | 4.16 | 0.8 | 0.04 |
| Alloy A | 5.52 | 0.05 | 0.43 | 6.42 | 13.82 | 0.81 | 0.45 | 48.05 | 19.78 | 0.73 | 3.31 | 0.6 | 0.03 |

Figure 4:
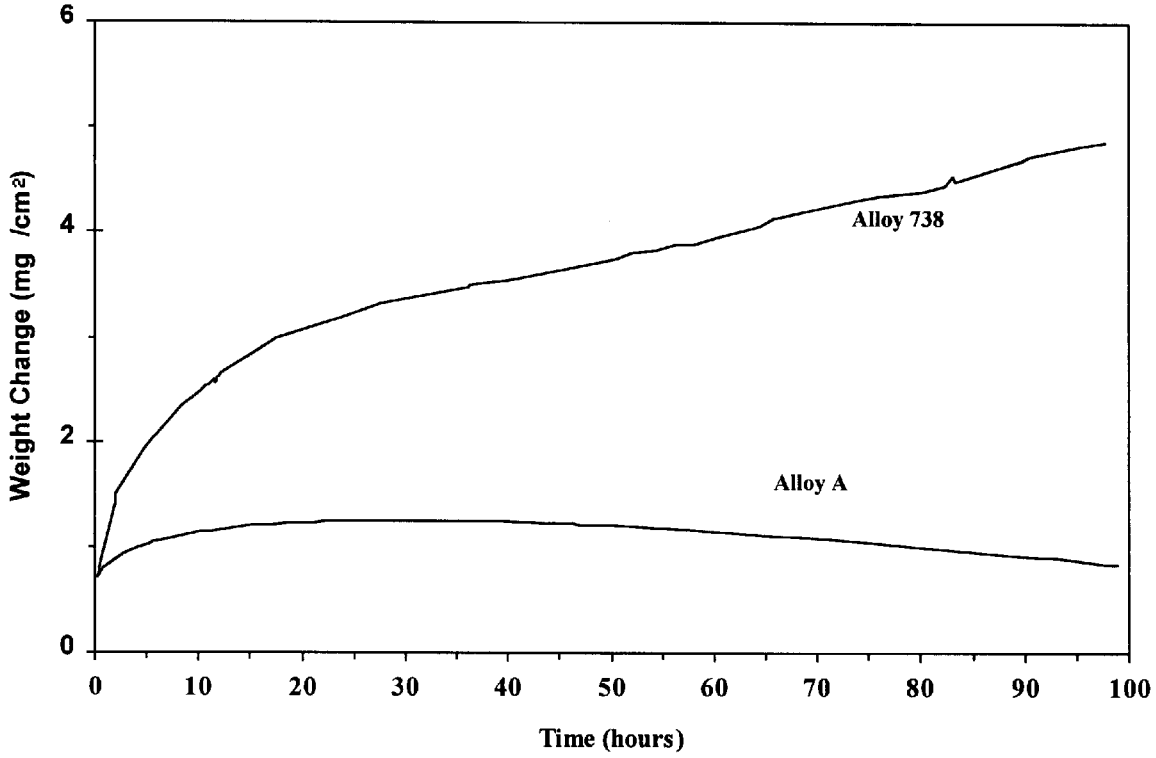
FIG. 4 shows 1150° C. isothermal oxidation results for the alloys listed in table 5.
Figure 5:
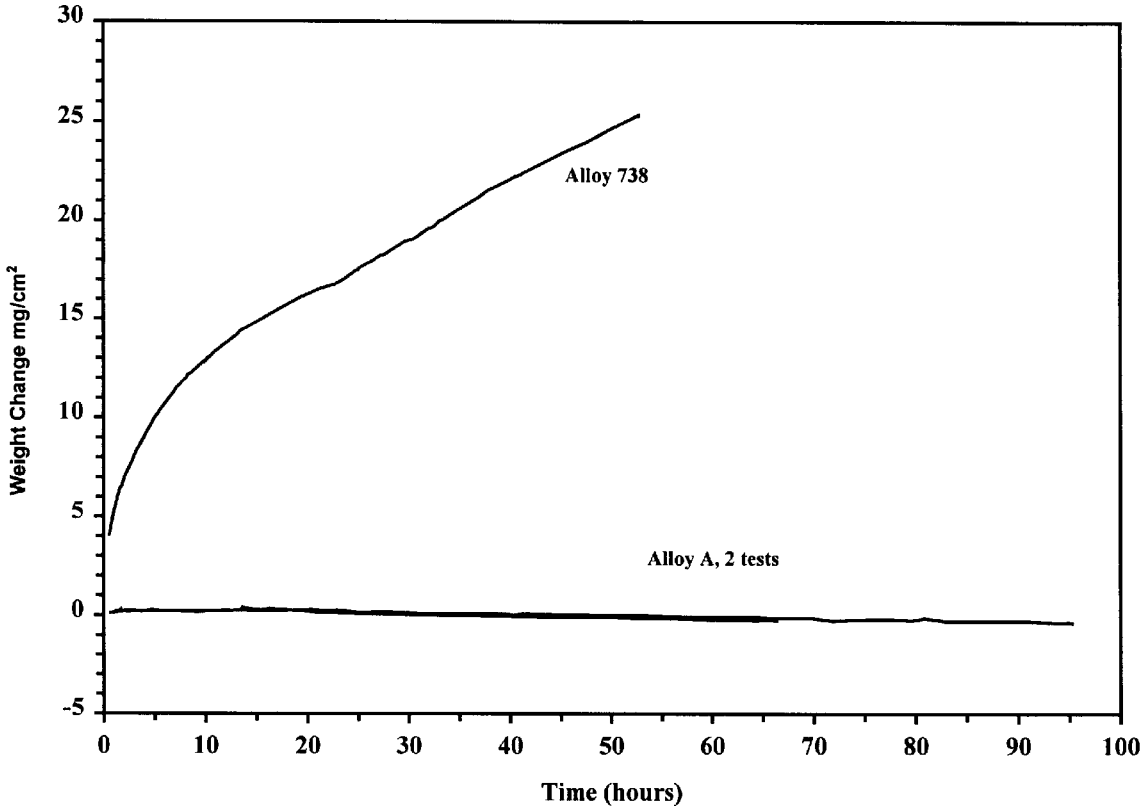
FIG. 5 shows 1200° C. isothermal oxidation results for the alloys listed in table 5.

FIG. 4 shows 1150° C. isothermal oxidation results for the alloys listed in table 5. Note that the base alloy Alloy 738 oxidizes at a significantly faster rate than Alloy A, despite the reduction of Cr and Al in Alloy A due to the addition of Pd.

EXAMPLE 3

To improve the weldability and oxidation resistance of an existing superalloys it is proposed to substitute nickel with palladium in such a way as to maintain the atom fractions of all other elements in the alloy. This can be accomplished by setting the Ni+Pd combined atom fraction to a level equal to the atom fraction of Ni in the base alloy. This technique is illustrated in Table 6. The atomic percentage of Ni in unmodified Alloy 738 is nominally 67.70. By adding palladium and keeping the Ni+Pd level equal to 67.70 then the atom fraction of the remaining constituents will remain unchanged.

TABLE 6

| | Constant Atomic Percentage of Solute | | | | | | | | | | | | |
|---|---|---|---|---|---|---|---|---|---|---|---|---|---|
| | Elements (atomic percent) | | | | | | | | | | | | |
| | Al | B | C | Co | Cr | Mo | Nb | Ni | Pd | Ta | TI | W | Zr |
| Alloy C | 5.56 | 0.05 | 0.43 | 6.43 | 13.82 | .82 | 0.45 | 62.68 | 5.02 | 0.74 | 3.34 | 0.63 | 0.03 |
| Alloy B | 5.56 | 0.05 | 0.43 | 6.43 | 13.82 | .82 | 0.45 | 57.70 | 10.00 | 0.74 | 3.34 | 0.62 | 0.03 |
| Alloy A | 5.52 | 0.05 | 0.43 | 6.39 | 13.74 | .81 | 0.45 | 48.12 | 19.78 | 0.73 | 3.31 | 0.62 | 0.03 |

Figure 6:
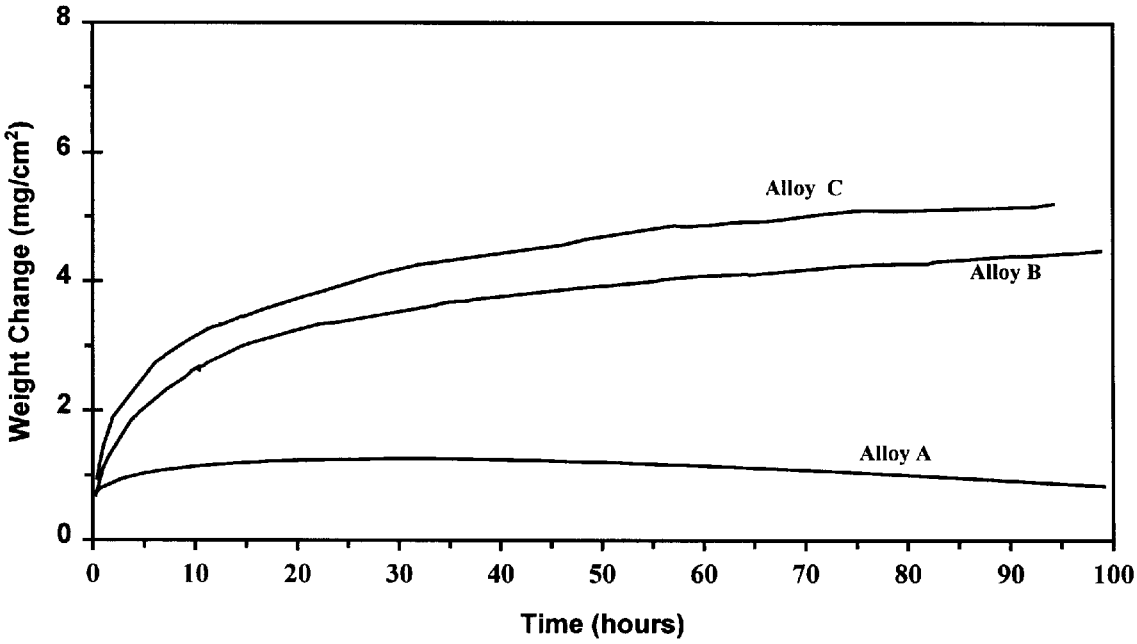
FIG. 6 shows the 1150° C. isothermal oxidation results for three alloys with equivalent solute contents and varying Pd amounts.

FIG. 6 shows the 1150° C. isothermal oxidation results for three alloys with equivalent solute contents and varying Pd amounts. Note that as Pd levels increase the oxidation rate and total weight gain decreases. The exact level of palladium substitution will be dictated by the amount of palladium necessary to achieve improved weldability and sufficient oxidation resistance, which is determined experimentally.

EXAMPLE 4

The design and of a new alloy that maximizes the benefits of the addition of palladium to a superalloy may be the best approach for newly design components or redesign of existing components. The design of a new alloy requires knowledge of the intended application or applications. For gas turbine operating temperatures between about 430° C. and about 980° C. hot corrosion may be dominating mechanism of metal attack. Therefore a newly designed alloy for this temperature range must be resistant to hot corrosion. Typically chromium is added to alloys to increase hot corrosion resistance via the formation of a $Cr_2O_3$ scale. To improve weldability of these alloys, palladium is added in an amount suitable to obtain the desired weldability. Table 7 shows compositional ranges that would exhibit hot corrosion resistance and improved weldability. It is preferred that the composition consists essentially of only these elements. Also, in one preferred embodiment, the amount of Pt, Hf, Y, and Sc is zero.

TABLE 7

| Element | Range (wt. %) | Preferable Range (wt. %) | Most Preferable Range (wt. %) |
|---|---|---|---|
| Al + Ti | 0.5–10 | 1–9 | 2–5.5 |
| B | 0–0.01 | 0–0.007 | 0.006 |
| C | 0–0.15 | 0–0.1 | 0.03 |
| Co | 0–25 | 2–20 | 3–15 |
| Cr | 5–30 | 10–25 | 12–22 |
| Fe | 0–70 | 0–30 | 5 max |
| Hf + Y + Sc | 0–0.009 | 0–0.005 | 0.005 max |
| Mo and/or W | 0.5–20 | 1–15 | 1.5–12 |
| Nb and/or Ta | 0–8 | 0–7 | 0–5 |
| Ni | 0–70 | 10–68 | 18–63 |
| Pd | 2–50 | 2–45 | 5–40 |

TABLE 7-continued

| Element | Range (wt. %) | Preferable Range (wt. %) | Most Preferable Range (wt. %) |
|---|---|---|---|
| Pd + Ni + Fe | 50–72 | 55–70 | 58–68 |
| Re and/or Rh | 0–10 | 0–5 | 0.05 max |
| V | 0–5 | 0–0.5 | 0.1 |
| Zr | 0–.015 | 0–.01 | 0.005 max |

EXAMPLE 5

The design of a new alloy that maximizes the benefits of the addition of palladium to a superalloy may be the best approach for newly designed components or redesign of existing components. The design of a new alloy requires knowledge of the intended application or applications. For gas turbine operating temperatures above about 870° C., oxidation is the dominating mechanism of base metal attack. Therefore a newly designed alloy for this temperature range must be resistant to oxidation. Typically aluminum is added to alloys to increase oxidation resistance via the formation of an $Al_2O_3$ scale. To improve weldability of these alloys, palladium is added in an amount suitable to obtain the desired weldability. Table 8 shows compositional ranges that would exhibit oxidation resistance and improved weldability. It is preferred that the composition consists essentially of only these elements. Also, in one preferred embodiment, the amount of Pt, Hf, Y, and Sc is zero.

TABLE 8

| Element | Range (wt. %) | Preferable Range (wt. %) | Most Preferable Range (wt. %) |
|---|---|---|---|
| Al + Ti | 1–10 | 3–9 | 3–7.5 |
| B | 0–0.01 | 0–0.007 | 0.006 max |
| C | 0–0.15 | 0–0.1 | 0.03 max |
| Co | 0–20 | 2–15 | 3–12 |
| Cr | 0–20 | 2–15 | 3–12 |
| Fe | 0–10 | 0–5 | 0.5 max |
| Hf + Y + Sc | 0–0.009 | 0–0.005 | 0.005 max |
| Mo and/or W | 0.5–20 | 1–18 | 1.25–15 |
| Nb and/or Ta | 0–10 | 0–8 | 0–6 |
| Ni | 0–70 | 4–68 | 12–60 |
| Pd | 2–55 | 3–52 | 5–45 |
| Ni + Pd | 55–72 | 56–71 | 57–65 |
| Re and/or Rh | 0–10 | 0–5 | 0.05 max |
| V | 0–5 | 0–0.5 | 0.1 max |
| Zr | 0–.015 | 0–.01 | 0.005 max |

EXAMPLE 6

Turbine blade tips are currently repaired using a number of different processes and materials. Repair cost is of primary importance to the engine owner. The most cost effective repair is to use an alloy with excellent weldability and apply a new tip using a manual tungsten-inert-gas welding process. In some cases, a more precise welding process such as plasma transferred arc or laser is used to reduce repair costs. However, as previously described, alloys with excellent weldability lack strength and oxidation resistance. In recent years investigators have tried several methods use advanced alloys as weld fillers. One technique is to preheat the component to be repaired to very high temperatures (400–1100° C.). The idea being that the high temperature preheat will reduce cracking. Although this method has limited success it suffers from several problems. One problem is that the high preheat may increase base metal cracking. Another problem is the cost associated with the preheat. Preheating parts requires expensive equipment and extra process controls, often reducing productivity, increasing reject rates. The alloys in this invention can be used to repair components such as turbine blades, combusters, seals, vanes, and shafts by conventional repair procedures. This is advantageous because no additional equipment is required to use the new alloy. Component repair costs is kept to a low value.

There are several ways the new alloys can be used for repair. One way is to use a weld filler alloys that has a composition based on the original component alloy but modified with Pd (as outlined in Example 1 and 2). Another way is to use a completely new alloy based on the compositions (as outlined in Examples 3 and 4).

EXAMPLE 7

Figure 7:
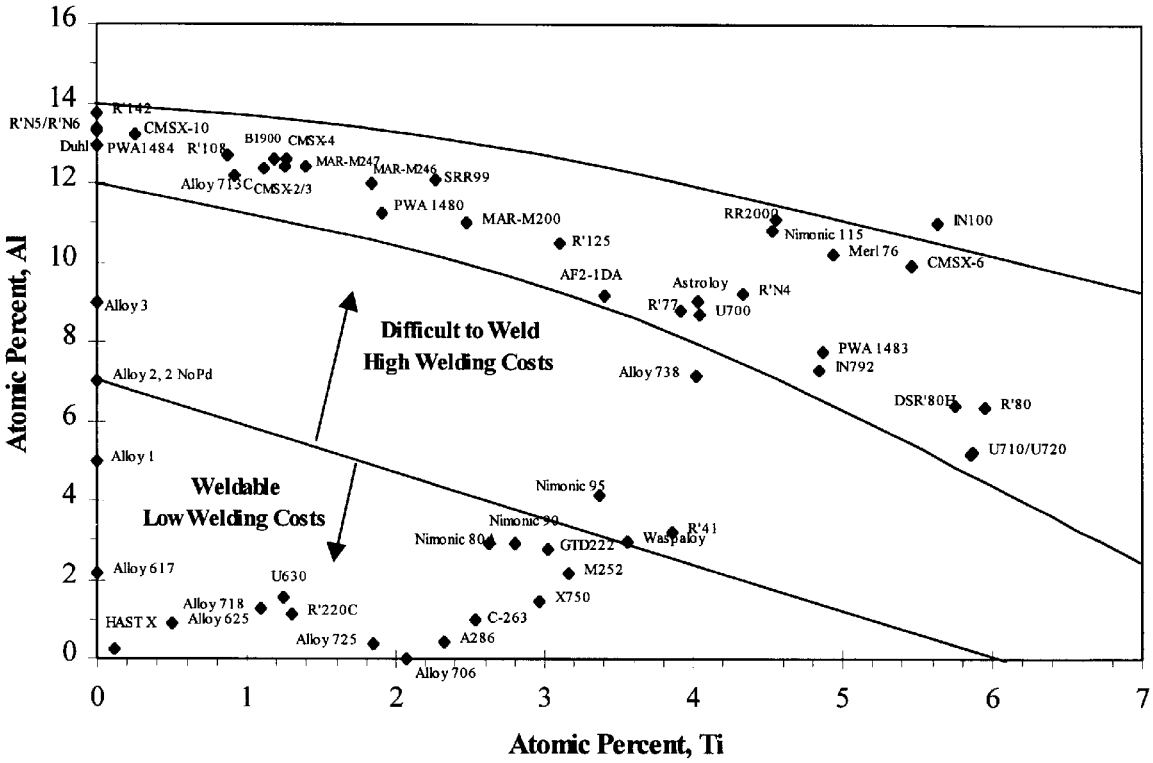
FIG. 7 shows the weldability of superalloys as a function of aluminum and titanium content (atomic %) in superalloys, including alloys of the present invention and those of the prior art.

To gain additional understanding as to the best compositions for obtaining both high oxidation resistance and high weldability, applicant performed additional testing. Four experimental alloys were fabricated. The nominal composition of each alloy is shown in Table 9. The weight percentages are shown in parentheses. The only difference between Alloy 1, 2 and 3 is the amount of aluminum. The alloys are plotted on FIG. 7 and as can be seen Alloy 1 should be weldable, Alloy 2 is borderline, and Alloy 3 should be the most difficult of the three to weld. Alloy 2 NoPd was included as a baseline for oxidation tests as will be shown later. Alloys 1, 2 and 3 are all within the scope of applicant's invention.

TABLE 9

Composition of Experimental Alloys 1, 2, 2 NoPd, and 3, Atom Percent

| Element | Alloy 1 atom % (wt. %) | Alloy 2 atom % (wt. %) | Alloy 2 NoPd atom % (wt. %) | Alloy 3 atom % (wt. %) |
|---|---|---|---|---|
| Al | 5 (2.1) | 7 (3.0) | 7 (3.3) | 9 (3.9) |
| Co | 10 (9.1) | 10 (9.3) | 10 (10.2) | 10 (9.4) |
| Cr | 18 (14.6) | 18 (14.7) | 18 (16.2) | 18 (14.9) |
| Mo | 6 (8.9) | 6 (9.1) | 6 (9.9) | 6 (9.1) |
| Nb | 1 (1.4) | 1 (1.5) | 1 (1.6) | 1 (1.5) |
| Ni | 48 (43.9) | 46 (42.5) | 58 (58.8) | 44 (41.0) |
| Pd | 12 (19.9) | 12 (20.1) | 0 (0) | 12 (20.3) |

One type of weldability trial performed at Penn State consisted of a modified circular patch test. The specimen material was Alloy 625 and total sample thickness was 6.35 mm. Testing consisted of a two-pass laser weld. The first pass fused powder that was pre-placed in the groove, level with the sample surface. A laser was used to fuse the pre-placed powder. Powder was then pre-placed again using a specially constructed tool. Sufficient powder was pre-placed for the second pass, that after laser fusing a positive reinforcement was achieved. The height of the build-up was approximately 0.5 mm above the original substrate.

A 3 kW continues wave Nd:YAG laser was used for all laser weld trials. In addition to the alloys listed in Table 9 two other alloys, R'80 and Alloy 625 were tested. R'80 represents a typical superalloy that has poor weldability and Alloy 625 represents an alloy that has exceptionally good weldability. Table 10 shows the nominal compositions of these alloys. It is clear that R'80 is a gamma prime forming alloy while Alloy 625 is not. This is the primary reason for the difference in weldability between these two alloys.

TABLE 10

Composition of R'80 and Alloy 625, Atom Percent

| Element | R'80 atom % | Alloy 625 atom % |
|---|---|---|
| Al | 6.35 | 0 |
| B | 0.08 | 0 |
| C | 0.81 | 0.35 |
| Co | 9.2 | 0 |
| Cr | 15.37 | 24.7 |
| Mo | 2.38 | 5.60 |
| Nb | 0 | 2.25 |
| Ni | 58.6 | 67.10 |
| Ti | 5.96 | 0 |
| V | 1.24 | 0 |
| Zr | 0.02 | 0 |

The same laser weld parameters were used for the weld trials, i.e., they were not optimized for each composition. Further, weldability is often difficult to determine with a high degree of analytical accuracy. This is because the formations of cracks in the weld are dependent not only on the metallurgical aspects of the weld but also on mechanical considerations, such as weld joint restraint. Table 11 lists some of the relevant laser weld parameters.

TABLE 11

Laser Parameters for Weldability Trials

| Parameter | Value |
|---|---|
| Laser Power | 3 kW |
| Laser Focus | @ focus |
| Laser Type | Nd:YAG, CW |
| Powder | Preplaced |
| f-number | 16 |
| Shield Gas | Ar |
| Travel Speed | 20 IPM |

After welding, the samples were heat treated by heating the samples in air to 1100° C. in about 50 minutes, holding for 5 minutes and air-cooling. The purpose of the heat treatment was to induce cracks due to thermal cycling. The samples were not aged since the preferred aging temperatures for all the alloys were not known. Table 12 lists the results of a visual inspection (10–50× magnification) of the weld bead after heat-treating. Cracking that occurred during the stop/start of the weld was not included in the analysis since this type of cracking may be dramatically affected by the weld schedule and no attempt was made to alter the weld schedule to reduce cracking in the stop/start region. Because the weld parameters were not refined each composition and some improvement in welding results is expected with additional experimentation.

TABLE 12

Weldability Results using Non-optimized Parameters on a Nd:YAG laser

| Alloy Type | Results, after H.T. |
|---|---|
| Alloy 625 | No cracks |
| Alloy 1 | No cracks |
| Alloy 2 NoPd | No cracks |
| Alloy 2 | No cracks |
| Alloy 3 | Cracked |
| R'80 | Cracked |

Weldability testing was also conducted on Alloys 1, 2, 2 NoPd, and 3 using a carbon dioxide laser and feeding the powder directly into the beam. Again, welding parameters were not optimized and cracking in the stop/start of the weld was not included in the analysis. The results are summarized in Table 13.

TABLE 13

Weldability Results using Non-optimized Parameters on a $CO_2$ laser

| Alloy Type | Results, after H.T. |
|---|---|
| Alloy 625 | Not tested |
| Alloy 1 | No cracks |
| Alloy 2 NoPd | No cracks |
| Alloy 2 | No cracks |
| Alloy 3 | No cracks |
| R'80 | Not Tested |

The results of the weldability testing show that Alloys 1 and 2 are definitely weldable with a minimum of weld parameter development. Alloy 3 which is considered the most difficult of the three exhibited crack free welds when welded by experienced personnel. In conclusion, Alloy 3 is weldable when as predicted by the information shown in FIG. 7 that it is not weldable. The difference is applicant's discovery that the addition palladium improves the weldability of superalloys without sacrificing other desirable properties of the alloy.

Oxidation Testing on Alloys 1, 2, 2 NoPd, and 3

Figure 8:
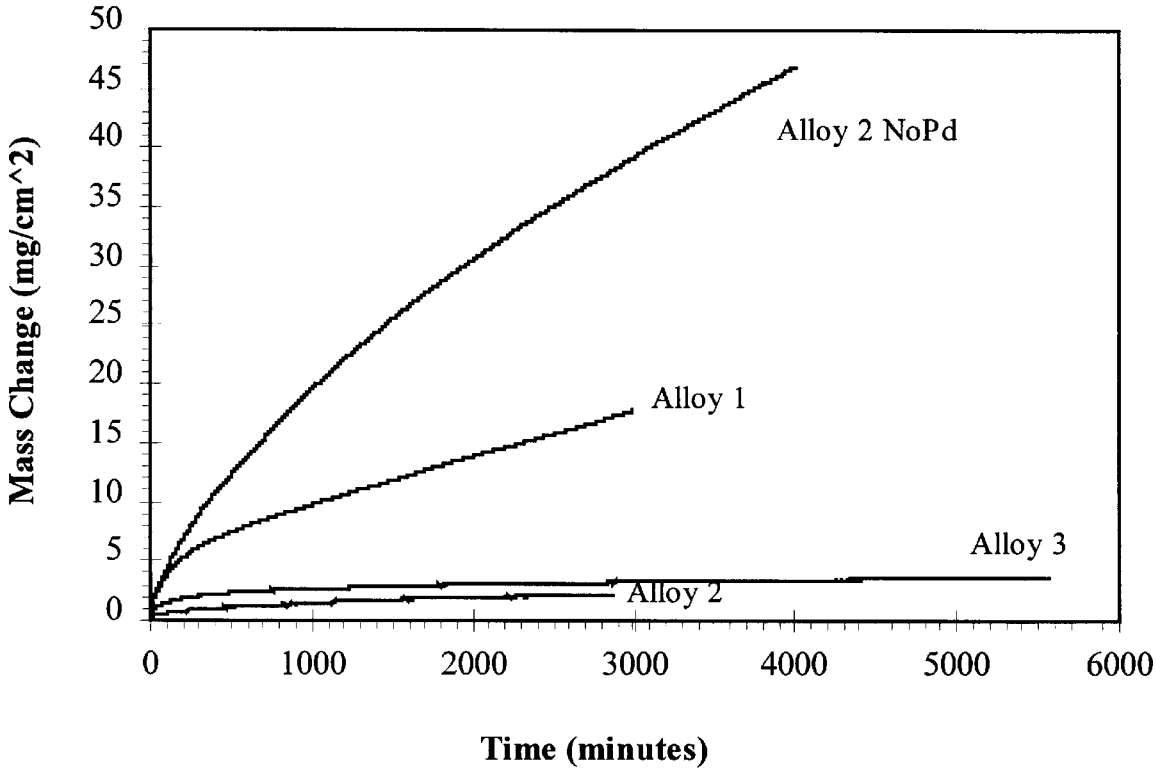
FIG. 8 shows the oxidation behavior of Alloys 1, 2, 2 NoPd, and 3 at 1200° C.

FIG. 8 shows the oxidation behavior of Alloys 1, 2, 2 NoPd, and 3 at 1200° C. First, compare the difference between Alloy 2 NoPd and Alloy 2. This shows the effect Pd has on oxidation resistance. Alloy 2 NoPd is by far the worst alloy in oxidation resistance but the substitution of 12 atomic percent Pd for Ni (Alloy 2) decreases the oxidation rate dramatically. Second, note the difference between Alloy 1 and Alloys 2 and 3. This shows the effect of aluminum on the oxidation resistance. Under these experimental conditions, Alloy 1 with 5 atomic percent aluminum oxidized more than Alloys 2 and 3 with 7 and 9 atomic percent aluminum respectively. These results confirm earlier results on the role Pd and Al have on the oxidation resistance of alloys containing both elements.

Oxidation Testing of Alloys Containing Cr and Pd

Figure 9:
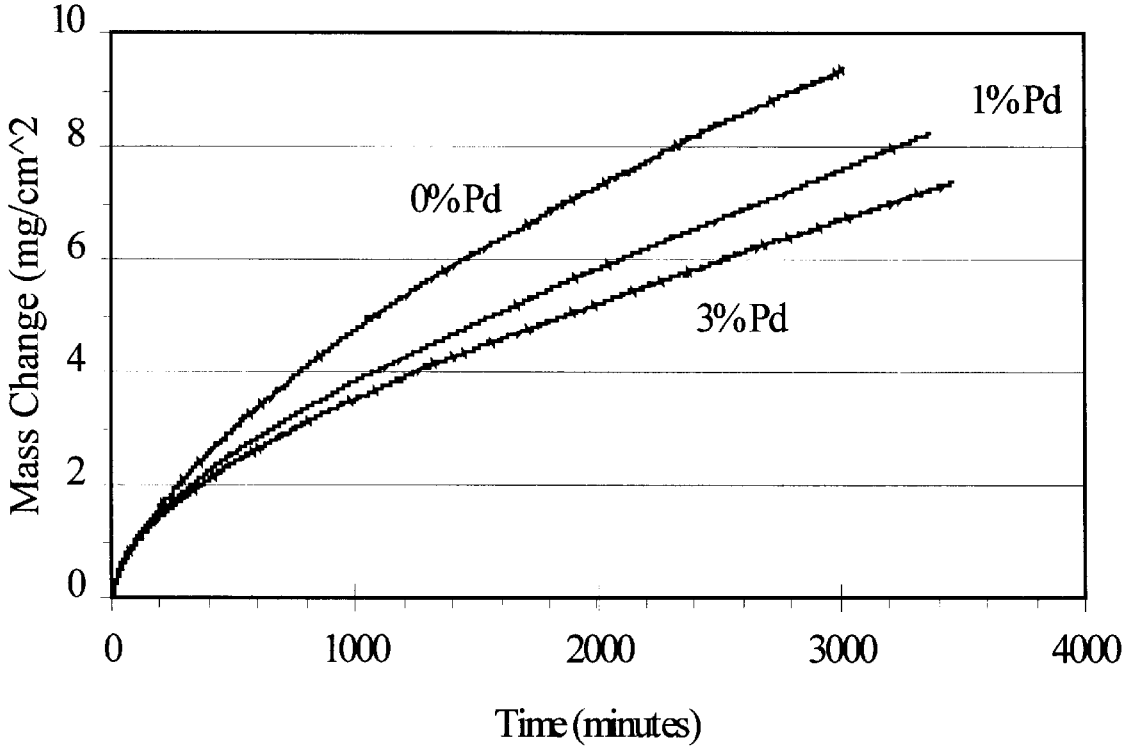
FIG. 9 shows isothermal oxidation of Alloy 625 and Pd-modified Alloy 625 at 1200° C.

Pd-modified Alloy 625 mixtures were prepared for oxidation testing. The composition of the alloys is shown in Table 14. The results of the oxidation testing are shown in FIG. 9.

TABLE 14

Nominal Composition of Test Alloys Based on Alloy 625

| | Atomic Percent (wt. %) | | | | |
|---|---|---|---|---|---|
| Alloy Type | Cr | Ni | Mo | Nb | Pd |
| Alloy 625 | 24.7 | 68.25 | 5.6 | 1.45 | 0 |
| | (21.5) | (67.3) | (8.9) | (2.3) | (0) |
| Alloy 625 + | 24.7 | 67.25 | 5.6 | 1.45 | 1 |
| 1%Pd | (21.3) | (65.7) | (8.9) | (2.2) | (1.8) |
| Alloy 625 + | 24.7 | 65.25 | 5.6 | 1.45 | 3 |
| 3%Pd | (21.0) | (62.8) | (8.7) | (2.2) | (5.77) |

It is evident that even small levels of palladium act to retard oxidation. The data shown in FIG. 9 show that Pd is effective even in alloys that do not contain aluminum. However, as shown in FIG. 8 Pd and Al have an additive effect on oxidation resistance, which is why both Pd and Al are required elements in the most preffered embodiments of the instant invention.

Accordingly applicant has discovered that superalloys within the compositional ranges expressed below are preferred embodiments of the invention for the best combination of oxidation resistance and high weldability.

| Element | Range (wt. %) |
|---|---|
| Al + Ti | 1–9 |
| B | 0–0.01 |
| C | 0–0.15 |
| Co | 0–25 |
| Cr | 5–30 |
| Fe | 0–10 |
| Hf + Y + Sc | 0–0.009 |
| Mo + W | 1–15 |
| Nb + Ta | 0–8 |
| Ni | 40–68 |
| Pd | 4–32 |
| Re + Rh | 0–10 |
| V | 0–5 |
| Zr | 0–0.015 |

Additionally, it is preferred that the wt % of Al is $1 \leqq Al < 4$ and the total amount of Pd+Ni lies is the range of 55–72 wt. %.

In an even more preferred embodiment the compositional ranges fall within the scope of the following where the wt % of Al is between 2 and 3 and the amount of Ta is ≦5 wt % and the total amount of Pd+Ni lies is the range of 55–72 wt %.

| Element | Range (wt. %) |
|---|---|
| Al + Ti | 2–4 |
| B | 0–0.006 |
| C | 0–0.03 |
| Co | 3–15 |
| Cr | 10–25 |
| Fe | 5 max |
| Hf + Y + Sc | 0–0.005 max |
| Mo + W | 1.5–12 |
| Nb + Ta | 0–7 |
| Ni | 45–63 |
| Pd | 8–27 |
| Re + Rh | 0.05 max |
| V | 0.1 max |
| Zr | 0–0.005 max |

Additionally, it is preferrable that the gamma prime fraction of these preferred embodiments are ≦about 45% and even more preferably ≦about 35%. At levels above this amount, the alloys are more susceptible to strain age cracking and are thus not weldable.

The volume fraction of gamma prime can be determined by gamma prime extraction, transmission electron microscopy image analysis, and in certain cases, where the gamma prime particles are large, by scanning electron microscopy image analysis. Image analysis should be in accordance with ASTM E562, Standard Test Method for Determining Volume Fraction by Systematic Manual Point Count. Image analysis can also be done using an automatic electronic image analyzer and software provided proper calibration procedures have been performed. In the case of image analysis, up to 30 different areas should be evaluated to provide a sound statistical base for the determination.

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

We claim:

1. A fusion weldable alloy consisting essentially of:

| Element | Range (wt. %) |
|---|---|
| Al + Ti | 1–9 |
| B | 0–0.01 |
| C | 0–0.15 |
| Co | 0–25 |
| Cr | 5–30 |
| Fe | 0–10 |
| Hf + Y + Sc | 0–0.009 |
| Mo + W | 1–15 |
| Nb + Ta | 0–8 |
| Ni | 40–68 |
| Pd | 4–32 |
| Re + Rh | 0–10 |
| V | 0–5 |
| Zr | 0–0.015 |

wherein the wt % of Al is 1≦Al<4 and the total amount of Pd+Ni lies is the range of 55–72 wt. %.

2. A fusion weldable alloy consisting essentially of:

| Element | Range (wt. %) |
|---|---|
| Al + Ti | 1–9 |
| B | 0–0.01 |
| C | 0–0.15 |
| Co | 0–25 |
| Cr | 5–30 |
| Fe | 0–10 |
| Hf + Y + Sc | 0–0.009 |
| Mo + W | 1–15 |
| Nb + Ta | 0–8 |
| Ni | 40–68 |
| Pd | 4–32 |
| Re + Rh | 0–10 |
| V | 0–5 |
| Zr | 0–0.015 |

wherein the wt % of Al is between 1 and 3 and the amount of Ta is ≦5 wt % and the total amount of Pd+Ni lies is the range of 55–72 wt %.

* * * * *